United States Patent [19]

Brothers

[11] Patent Number: 4,674,752

[45] Date of Patent: Jun. 23, 1987

[54] STATE TRIVIA BOARD GAME

[76] Inventor: Bradford Brothers, 6308 S. Bay Rd., Clay, N.Y. 13041

[21] Appl. No.: 867,139

[22] Filed: May 27, 1986

[51] Int. Cl.[4] ..... A63F 3/00

[52] U.S. Cl. ..... 273/254; 273/276; 273/282; 273/239; 273/DIG. 30

[58] Field of Search ..... 273/251, 252, 254, 243, 273/248, 282 R, 282 C, 276; 434/150

[56] References Cited

U.S. PATENT DOCUMENTS

| | | | |
|---|---|---|---|
| 1,346,826 | 7/1920 | Huggins . | |
| 1,635,734 | 7/1927 | Ziegler . | |
| 3,658,337 | 4/1972 | Peters et al. . | |
| 4,061,336 | 12/1977 | Lincoln | 273/254 |
| 4,090,717 | 5/1978 | Rossetti . | |
| 4,095,800 | 6/1978 | Konsolas . | |

OTHER PUBLICATIONS

"Trivial Pursuit"; Master Game–Rules of Play; copyright 11/1981.

Pressman, "Know the Use—The Transcontinental Quiz Game for Kids"; game instructions, board, pieces, Apr. 1986.

*Primary Examiner*—Richard C. Pinkham
*Assistant Examiner*—Matthew L. Schneider
*Attorney, Agent, or Firm*—Bruns and Wall

[57] ABSTRACT

A state or territory trivia game has a game board bearing a map or representation of a particular state or territory, and that representation is divided into eight color coded sections or regions. Each section represents a different region of the state or territory. On the sides of the board are smaller representations of the state or territory. These are used for the collection of game collection pieces. Game question and answer cards have eight questions relating to the history, geography, etc. of the respective regions of the state or territory, and the answers provided on the other side of the card. The card is arranged so that the answers cannot readily be seen as the question is being asked. The game begins with each player in the state capital or in some other predetermined city, and the player moves his or her piece a number of squares across the board in correspondence with the roll of a die or other randomizer. The object is to answer questions correctly while the transit piece occupies a city station earning a collection piece. The winner of the game is the first player to earn all eight collection pieces.

15 Claims, 7 Drawing Figures

STATE TRIVIA BOARD GAME

BACKGROUND OF THE INVENTION

This invention relates to parlor games and board games, and is more particularly directed to the so-called "trivia" games, in which a player is asked to answer a question pertaining to a category that is identified by the position of his or her piece on the board. The invention is further directed to games in which the players earn points, credits, or the like by correctly answering questions of particular categories.

A number of question-and-answer or trivia games have found favor recently, but none of these have had its focus on the history, lore, or geography of a particular state, group of states, territory, or country. There have been several board games proposed which have a state, country, kingdom, or principality as a theme, but these have not involved specific knowledge of the history, geography, customs, or lore of the geographical subdivisions of the territories involved. Typical ones of these games are described in U.S. Pat. Nos. 3,658,337, 1,346,826, 3,939,578, 1,635,734, and 4,095,800.

Accordingly, the previously-proposed games of this general type have not attempted to educate players as to the general history and geography of the various sections of their own state or territory, or of perhaps another state or territory in which they may be interested.

OBJECTS AND SUMMARY OF THE INVENTION

Accordingly, it is an object of this invention to provide an educational and amusing game which has as its theme the geography, history, customs and/or lore of the various geographical regions of a particular state, territory, group of states, country, etc.

It is another object of this invention to provide a board game in which players ask each other questions about the various regions of a state or territory, and in which the players' knowledge about the various regions of the particular state or territory is increased as a result of playing the game.

In accordance with an aspect of this invention, apparatus are provided for playing this state or territory question-and-answer game, in which the players move men or transit pieces about a playing board, and are asked questions pertaining to the geographical regions of a particular geographical territory, such as a specific state of the United States. The object of the game is for a player to answer correctly questions about each of the geographical regions of the territory or state, and collect a game piece or collection piece for each of the regions. The game apparatus of this invention thus comprises a game board representation of the geographical territory involved, this representation being divided into a plurality of geographical game-board regions which each represent a commonly recognized region of the territory. There are at least two city stations or representations located in each of the game board regions and these represent principal commercial or population centers of that region. A pathway is formed of a succession of stations or playing squares and connects the several city stations. The pathway represents the network of major transportation arteries of the particular territory. The pathway leads in at least two directions from each of the city stations to link the same to at least two other city stations. There are several transit pieces or men provided, assigned one to each player or team of players, and these transit pieces are to be moved across the game board representation over the pathway to land on the pathway stations and the city stations. A randomizer device, for example a die, is used to generate as random numbers the number of stations a player is to move his or her assigned transit piece on any particular turn. There are a quantity of collection pieces provided, with several of each corresponding to each of the respective geographical regions, and there are a number of collection areas, provided and assigned one to each player or team. These collection areas are shaped similarly to the gameboard representation and are also divided into a like number of regions. The regions of the collection areas are shaped similarly to the corresponding regions of the game board representations, and each collection area includes means for receiving a respective one of the collection pieces.

The apparatus further includes a quantity of question cards, with each card containing on one side thereof a number of questions equal to the number of regions of the state or territory, so that each card has one question for each region of the geographical territory, pertaining to a historical or geographical fact peculiar to that region. Indicia are provided in association with these questions, and these indicate the region to which the question pertains. The other side of the question cards each contain the answers to these questions. Favorably, the answers each have associated with them indicia similar to those of the corresponding questions.

In a disclosed example, the board game pertains to a particular state of the United States, specifically to the State of New York. However, it should be understood that the term "state" or "territory" as used throughout could apply as well to a group of states such as the New England States taken together, the two Dakotas, the two Carolinas, etc., or could apply to a Canadian province or a group of provinces.

In the preferred embodiment, the collection pieces can be shaped to conform with the associated regions of the geographical representation and of the collection area, so that a player collecting all of the pieces would overlay his or her collection area with a corresponding assembly of collection pieces. However, other collection pieces could be used to advantage, for example, pins or the like.

In the favorable embodiments of this invention, the several geographical regions of the state or territory representation are colored with a respective characteristic color, and the regions of the collection areas and the collection pieces are color coded to match their associated geographical regions.

The above and many other objects, features and advantages of this invention will be more fully understood from the ensuing detailed description of a preferred embodiment, which should be considered in connection with the accompanying drawing.

DETAILED DESCRIPTION OF THE PREFERRED EMBODIMENT

Figure 1:
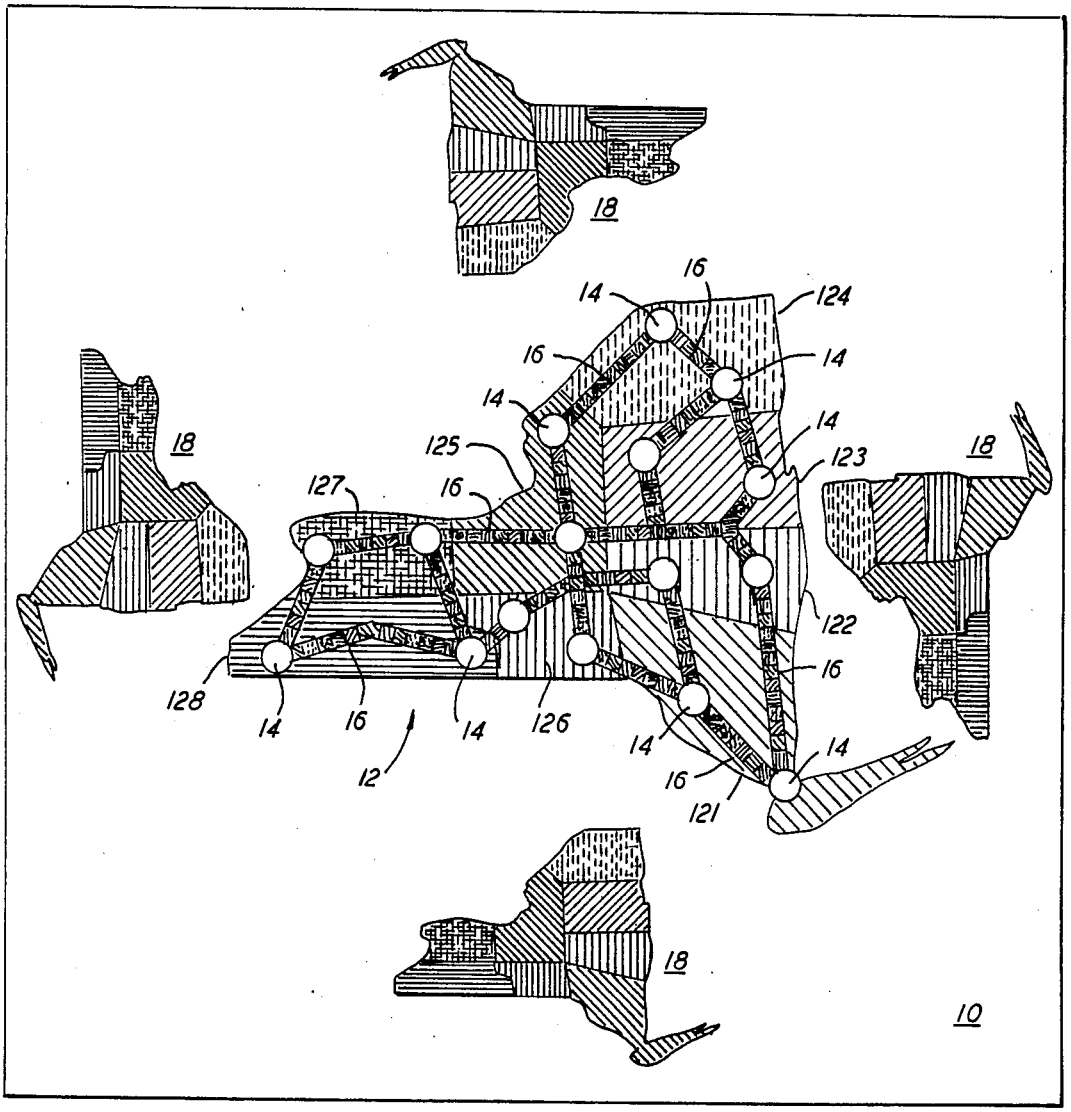
FIG. 1 is a plan view of a game playing board of the preferred embodiment of this invention.

With reference to the drawing, and initially to FIG. 1 thereof, a game board 10 contains a representation 12 of a particular territory; in this case, the representation 12 is a map of the State of New York. This representation 12 is divided into eight regions of the state, each of which is color-coded with a particular respective color. Here, these regions include a New York City and Long Island region 121, a Catskills region 122, a Capital District region 123, and Adirondack region 124, a Central New York and Thousand Islands region 125, a Finger Lakes Region 126, a Niagara and Ontario Shores region 127, and a Southern-Tier and Erie Shores region 128. Different versions of this board game could have more or fewer regions, depending on the skill or age level of the players for which the game is designed and, of course, depending on the state or territory involved.

There are provided two circular city spaces 14 in each of the eight regions 121–128, and each of these city spaces 14 represents a principal center for each region. A pathway 16 is formed of a series of square spaces and connects the various city spaces 14. The pathway generally follows the plan of the network of major highways and transportation routes within the state. In this example, the network of routes would correspond, for example, to the New York State Thruway, Interstate Highways Nos. 81 and 87, New York State Route 17, etc.

Also shown disposed, one at each side of the board 10, are four collection areas 18, which are miniature representations of the State of New York. These collection areas 18 are similarly divided into eight regions 181 to 188, which correspond in shape and in color coding to the regions 121 to 128 of the state map representation 12. The detail of the collection areas will be described later with reference to FIG. 5.

Figure 2A:
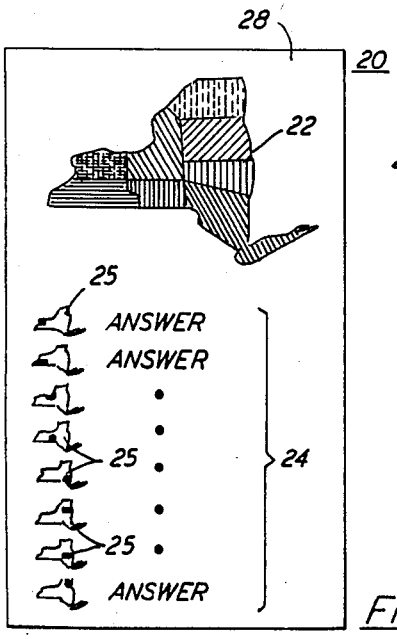
FIGS. 2A and 2B are front and reverse sides of a typical question card for use in playing the game of the preferred embodiment.
Figure 2B:
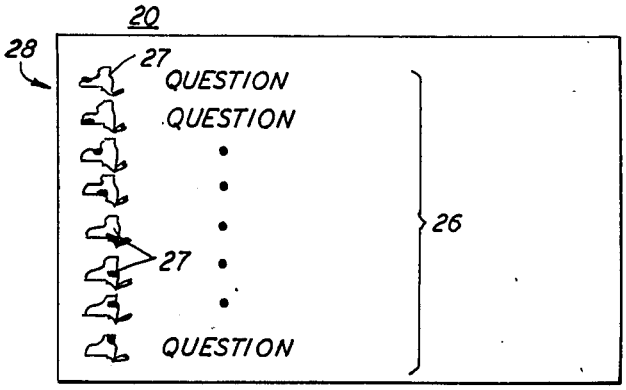

Turning now to FIGS. 2A and 2B, a typical question card 20 is shown to have an answer side (FIG. 2A) and a question side (FIG. 2B) on the reverse of the answer side. The answer side of the card is arranged in a vertical format, with a miniature representation 22 of the state at its upper end, this representation 22 being divided into eight regions and color coded to match the regions 121–128 of the state representation 12. A set of eight answers 24 is printed below this representation 22, each with a particular indicium 25 designed to indicate the region of the state for which that answer pertains. These indicia 25 are each an outline of the state, generally white or uncolored, with only the pertinent region of the state being highlighted, for example, by color coding to match the region 121–128.

The question side (FIG. 2B) of the card 28 contains a set of eight questions 26, with each question pertaining to a fact that is peculiar to the respective region 121–128 of the state. Indicia 27, similar to the indicia 25 are also provided as representations of the state with only the particular region thereof being highlighted, (e.g., color coded). These indicia 27 are aligned with the respective questions pertaining to those particular regions of the state.

The arrangement of the card 20, as shown, with the questions 26 running lengthwise on the card 20 and with the answers 24 running crosswise on the card, helps to shield the answers from being inadvertently revealed while a question is being read. That is, while the questions are being read by one player, the answers now being arranged from top to bottom keeps the other players from inadvertently seeing the answers.

Also, the question indicia 27 and the miniature representation 22 are both situated near a particular side edge 28 of the card 20 but on opposite sides.

Figure 3:
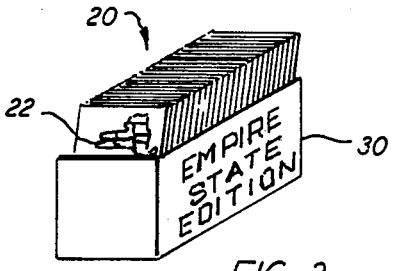
FIG. 3 shows an assembly of these question cards arranged in a box or holder.

As shown in FIG. 3, a quantity of these cards 20, each with a different set of questions and answers, is arranged in a stack in a card holder box 30. The question sides of the cards 20 all face in the same direction, and the answer sides all face in the other direction. As shown here, the cards are stacked with the miniature state representation 22 on the answer side of the end card being exposed over the top of the end of the box 30. The indicia 27 of the questions 26 of the other end card 20 would be exposed over the top edge of the box 30 (not visible in the drawing).

Figure 4:
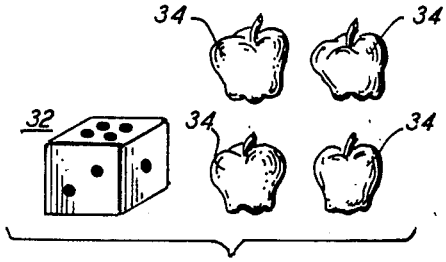
FIG. 4 illustrates other apparatus employed in playing of the game of this invention.

As illustrated in FIG. 4, game apparatus also includes a die 32 and a number of transit pieces or men 34, the latter to be assigned one per player to move along the pathway 14. For the New York State edition of this embodiment, these would be sculpted as apples, as that has become a commonly recognized symbol of the state. However, if the theme of the game involves a different state or territory, these transit pieces 34 could be otherwise shaped as a state symbol or mascot. For example, for a Kentucky version, the pieces could be racehorses, for Texas, cowboy hats, for Idaho, potatoes, for Hawaii, pineapples, or for Maine, pine trees.

Figure 5:
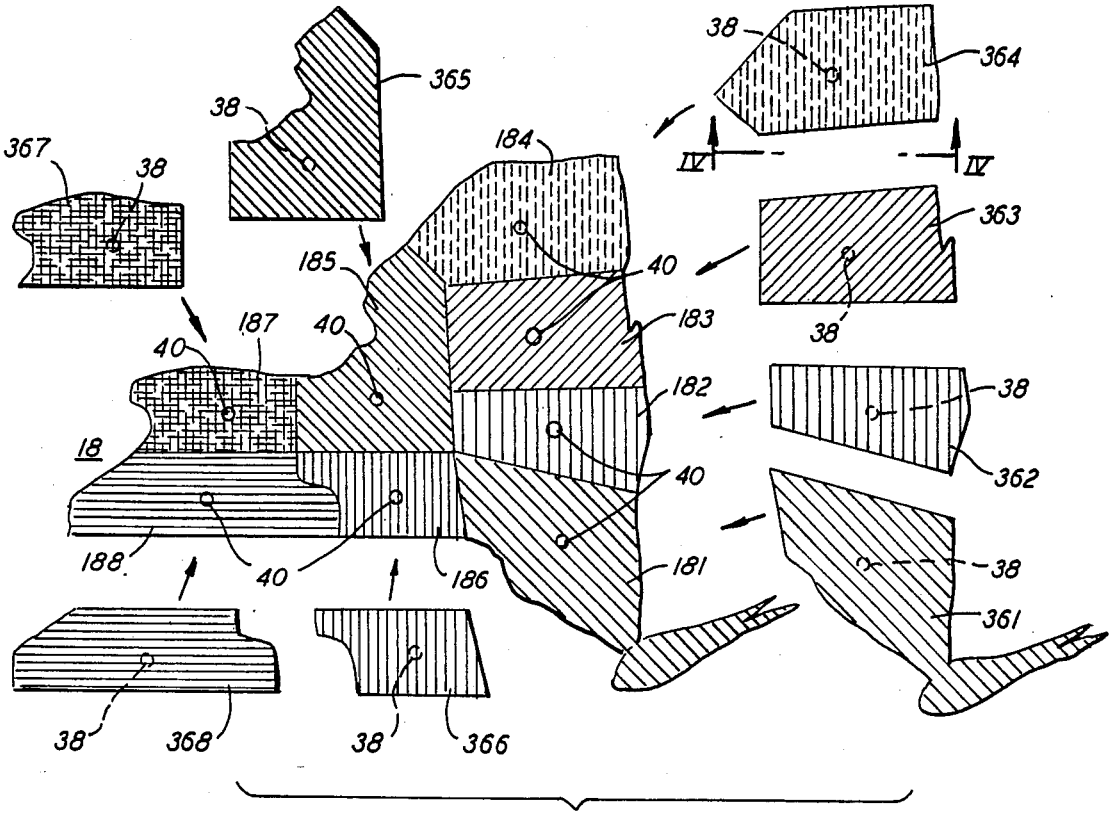
FIG. 5 shows detail of a collection area of the game board of FIG. 1, and associated collection pieces.
Figure 6:
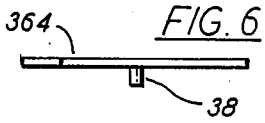
FIG. 6 is a sectional view taken along the lines VI—VI of FIG. 5.

FIGS. 5 and 6 show collection area detail. The regions 181 to 188 of each individual collection area 18 are shaped and color coded to match the corresponding regions 121 to 128 of the state representation 12. A group of collection pieces, here numbered 361 to 368 are earned by players who answer questions correctly, as described below. Typical examples of these collection pieces are shown here as pieces 361 to 368. These are preferrably shaped and colored to match the respective collection area regions 181 to 188. For the four-player version as shown here, with eight regions, there are a total of thirty-two collection pieces, four pieces each of the various colors and shapes.

In this version, a pin 38 is formed on the underside of each collection piece, and this pin 38 fits into a socket 40 that is provided within the corresponding region of the collection area 18.

A simpler or less sophisticated version of this game could employ as collection pieces simple pins that are appropriately color coded, disks, colored beads, etc. Furthermore, instead of employing the pin 38 and socket 40 arrangement, other means could be employed to secure the collection pieces to the respective regions of the collection areas. For example, magnets or Velcro could be used. Alternatively, the collection areas 18 could be cut out or recessed, with the collection pieces 361–368 being fit into the recessed areas 18 in a jigsaw-puzzle fashion.

The game is preferably played in the following fashion:

Up to four players or four teams of players may play at any one time. The starting team or player is determined by the highest roll of the die 32 and all movement on the board is determined by roll of the die. Each player chooses a transit piece 34 and begins the game by placing the piece 34 on either of the two city spaces 14 in the region which matches the color of the piece 34. Alternatively, the players can all begin at the state capital (Albany) city space 14. During any player's turn, the player rolls the die 32 and moves his or her piece 34 along the path 16 a number of stations equal to the number of spots on the die 32. One of the other players then removes one of the cards 20 from the box 30 and asks a question pertaining to the region where the player's transit piece 34 has landed. The player's turn continues as long as the questions are answered correctly. The appropriate collection piece 361–368 is earned by answering correctly the question which is asked when the player's transit piece 34 is situated on one of the two city spaces 14. In a preferred version of the game, the player must remain in a particular region 121–128 until the collection piece for that region is earned.

The pieces 34 can be moved in any direction, but only in one direction per roll of the die 32. The transit piece 34 for more than one player can occupy the same space without penalty.

Preferably, the game ends when one of the players has earned the collection pieces for all eight areas of the state. However, the game can continue until all but one of the players has collected all the collection pieces.

Of course, these rules can be varied by agreement of the players.

While a particular version of this game has been described in detail as the preferred embodiment, it should be recognized that the invention is not limited to that embodiment, and that many modifications and variations would present themselves to those skilled in the art without departure from the scope and spirit of this invention, as defined in the appended claims.

I claim:

1. Apparatus for playing a board game in which players move transit pieces about a playing board and are asked questions pertaining to geographical regions of a particular geographical territory, and whose object is for the player to answer correctly questions about each of the geographical regions, the apparatus comprising:

a game board representation of a geographical territory divided into a plurality of geographical game-board regions representing recognized regions of said territory, at least two city stations situated in each said game-board region representing principal centers of that region, and a pathway made up of a succession of stations and representing the major transportation arteries of said territory, said pathway leading in at least two directions from each said city station to link the same to at least two other said city stations;

a plurality of transit pieces, assigned one for each player, to be moved across said game board representation to land on said pathway stations and city stations;

a randomizer device for generating, as a random number, the number of stations a player is to move his or her assigned transit piece;

a plurality of collection pieces, with several of each corresponding to each said geographical region;

a plurality of collection areas, assigned one to each player, and being shaped similarly to said game board representation and being divided into a like plurality of regions, with the regions of said collection areas being shaped similarly to the corresponding regions of the game board representation, each said collection area region including means for receiving a respective one of said collection pieces; and a plurality of question cards each with one side thereof containing a plurality of questions, one question for each region of said geographical territory, such question pertaining to a historical or geographical fact peculiar to that region, and a like plurality of indicia each associated with a respective one of the questions and indicating the region to which such question pertains; and the other side thereof containing answers to said questions.

2. Board game apparatus of claim 1 wherein each of the regions of said game board representation is color coded with a respective color, and the regions of said collection areas are each coded with a matching color.

3. Board game apparatus of claim 2 wherein said collection pieces are color coded to match the colors of the respective game board representation regions.

4. Board game apparatus of claim 3 wherein said collection pieces are shaped to match the shape of the associated collection area regions.

5. Board game apparatus of claim 1 wherein said collection pieces are shaped to match the shape of the associated collection area regions.

6. Board game apparatus of claim 1 wherein said geographical game board representation is situated on a central area of a game board playing surface, and said collection areas are disposed at peripheral areas of said game board playing surface.

7. Board game apparatus of claim 1 wherein said indicia of said question cards are each shaped to resemble said geographical territory, with each of said indicia having a highlighted region corresponding to the region to which the associated question pertains.

8. Board game apparatus of claim 7 wherein each of said indicia has only the highlighted region thereof color coded to match the corresponding region of the game board representation of said territory.

9. Board game apparatus of claim 1 wherein each of the regions of said game board representation is coded with a different respective color, and one side of each of the question cards contains, at one end thereof, a similar representation of the territory divided into said regions and color coded to match the game board representation.

10. Board game apparatus of claim 1 wherein said question cards are generally oblong in shape, with one of the questions and the answers printed in the longer dimension on one side of the cards, and with the other of the questions and the answers printed in the shorter dimension on the other side of the cards.

11. Apparatus for playing a state trivia game in which players move pieces about a playing board and are asked questions pertaining to the geographical regions of a particular state, and whose object is for a player to answer correctly questions pertaining to all the geographical regions of the state; the apparatus comprising:

a game board bearing a map of the state that is divided into a number of geographical regions corresponding to recognized geographical regions of that state, at least two city stations in each said game-board region representing the principal centers of that region, and a pathway made up of a succession of stations and representing the major transportation arteries of the state, the pathway leading in at least two directions from each said city station to connect to at least two others of the city stations;

a plurality of transit pieces assigned one to each player, to be moved across the game board map along said pathway to land on said pathway stations and city stations;

a randomizer device for generating as a random number the number of stations a player is to move his or her assigned transit piece;

a plurality of collection pieces, with several of each corresponding to each of said geographical regions of the state;

a plurality of collection areas situated at player positions on said board and assigned one to each player, the collection areas being shaped as a map of said state and similarly divided into corresponding regions, with each region of the collection areas including means to receive a respective one of said collection pieces; and a plurality of question cards each having one side bearing a plurality of questions, one question for each said region of the state and pertaining to a historical or geographical fact peculiar to that region, and a like plurality of indicia each shaped similarly to said map of the state and highlighting the corresponding region thereof to which its associated question pertains; and each card having its other side bearing answers to said questions.

12. The state trivia board game apparatus of claim 11 wherein the state map geographical regions, the corresponding collection area regions, and the collection pieces associated with those geographical regions and collection area regions are color coded with respective distinctive colors for each of said geographical regions.

13. The state trivia board game apparatus of claim 11 wherein said transit pieces are likenesses of a symbol or mascot of said state.

14. The state trivia board game apparatus of claim 11 wherein said cards, at one end of the answer side thereof, bear an outline of the state with said regions marked therein and color coded to match corresponding regions of the state map of the game board, and the indicia provided in association with said questions and answers on the card each have a single region color coded to match the corresponding region of the outline, the single color-coded region of each of the indicia indicating the region of the state to which the associated question and answer pertain.

15. The state trivia board game of claim 11 wherein said collection pieces are distinctively shaped to match the region of the collection area for which the collection piece is to be received.

* * * * *